US007891037B2

(12) United States Patent
Richmond et al.

(10) Patent No.: US 7,891,037 B2
(45) Date of Patent: Feb. 22, 2011

(54) MOTORIZED WATERPROOF FLUID DISPENSER

(75) Inventors: David Richmond, Culver City, CA (US); Howard Richmond, Los Angeles, CA (US); Kurt Koptis, Yucca Valley, CA (US)

(73) Assignee: Tubetech, LLC, Culver City, CA (US)

( * ) Notice: Subject to any disclaimer, the term of this patent is extended or adjusted under 35 U.S.C. 154(b) by 0 days.

(21) Appl. No.: 11/941,879

(22) Filed: Nov. 16, 2007

(65) Prior Publication Data

US 2008/0125680 A1 May 29, 2008

Related U.S. Application Data

(63) Continuation-in-part of application No. 11/562,386, filed on Nov. 21, 2006, now abandoned.

(60) Provisional application No. 60/900,965, filed on Dec. 13, 2007.

(51) Int. Cl.
*G11B 23/50* (2006.01)

(52) U.S. Cl. ..... 15/97.1; 15/104.8

(58) Field of Classification Search ..... 15/97.1, 15/97.2, 24, 29–34, 104.8; 604/289, 291; 401/118, 125, 136, 137; 601/72, 159; 222/192
See application file for complete search history.

(56) References Cited

U.S. PATENT DOCUMENTS

| | | | | |
|---|---|---|---|---|
| 4,189,801 | A * | 2/1980 | Lanusse | 15/22.1 |
| 5,857,233 | A * | 1/1999 | Wynn | 15/97.1 |
| 7,044,938 | B2 * | 5/2006 | La Bianco et al. | 604/290 |
| 2008/0146977 | A1 * | 6/2008 | Hilditch | 601/72 |

* cited by examiner

*Primary Examiner*—Dung Van Nguyen
(74) *Attorney, Agent, or Firm*—Sheldon Mak & Anderson, PC; Elizabeth Swanson

(57) ABSTRACT

A motorized waterproof fluid dispenser and applicator is disclosed. The device manually dispenses at least one liquid from a filled container through one or more openings in the device's moving applicator surface. The device itself is waterproof, and designed to be used in a shower or bathtub. Pressure applied by a user during fluid application does not appreciably dampen applicator movement. The motor moving the applicator is suspended within the device allowing motion to be transmitted directly to the applicator while motion is only weakly transmitted to the outside of the device held by a user. Removable or disposable pads may be affixed to the applicator surface to present a variety of applicator surfaces or heat. The batteries may be replaced, providing for a long overall lifetime of the device while also providing for its inexpensive manufacture.

19 Claims, 13 Drawing Sheets

MOTORIZED WATERPROOF FLUID DISPENSER

CONTINUATION IN PART

This is a continuation in part application of MOTORIZED FLUID DISPENSER AND METHOD OF USE THEREFOR, U.S. Ser. No. 11/562,386 filed 21 Nov. 2006 now abandoned and of MOTORIZED WATERPROOF FLUID DISPENSER AND METHOD OF USE THEREFOR, PCT application number PCT/US07/76552 filed 22 Aug. 2007.

INCORPORATION BY REFERENCE

The inventors incorporate herein by reference the currently pending patent applications identified as MOTORIZED FLUID DISPENSER AND METHOD OF USE THEREFOR, U.S. Ser. No. 11/562,386 filed 21 Nov. 2006; VIBRA BAR APPLICATOR CONTAINER MIX-USE SOAPS AND CREAMS, U.S. Ser. No. 60/900,965 filed 13 Feb. 2007; and MOTORIZED WATERPROOF FLUID DISPENSER AND METHOD OF USE THEREFOR, PCT application number PCT/US07/76552 filed 22 Aug. 2007.

BACKGROUND OF DEVICE AND METHOD OF THIS DISCLOSURE

Skin care, hair care and other body care liquids, soaps, creams or fluids sold for personal use at home are often sold in dispensers. These dispensers contain the fluid until it is dispensed and applied to a targeted area, usually skin or hair.

Both of a user's hands are typically used while applying the fluid to a targeted surface. A user will employ one hand to force or to pour fluid from the dispenser, while the user's other hand is frequently used to position a targeted surface adjacent the dispenser aperture to receive the dispensed fluid. This surface may comprise the user's other hand, an area of targeted skin or hair, or an applicator.

After dispensing fluid, the user then typically applies the dispensed fluid over a targeted area of skin or hair by using the palms or fingers of one or both hands, or by using an applicator onto which fluid was applied. This can be done manually or by using a motorized massager or applicator which imparts movement to spread the fluid or to massage an area onto which fluid was previously applied.

Simple, manual fluid applicators include a user's hand or hands, or a material, for example gauze or cotton balls, onto which liquid has been dispensed. Some prior art liquid make-up containers include an applicator brush or sponge through which liquid make-up is dispensed and manually applied to a user's skin. Finally, there are some electric skin massagers that can be used to apply previously dispensed fluids onto skin or hair. However, there are no devices that simultaneously dispenses fluid and massages or mechanically applies the dispensed fluid into skin or hair while requiring the use of only one hand of the user.

When fluid is being applied, varying degrees of pressure and varying amounts of motion may be applied by the user, depending on the treatment being provided. With hand operated motorized devices, increased pressure on the applicator surface may affect the degree of movement of the massaging surface. If the applicator surface being pressed onto skin or hair is directly linked to the motor, pressure on the surface may slow or burn out the motor. Traditionally, massage units, electric toothbrushes and the like have employed stronger motors or gears to overcome this pressure.

Motorized personal massagers and the like are also prone to causing a user's hand to tingle or feel numb from holding the device during use because the vibration imparted to the applicator surface is typically transmitted to the device's handle directly. No vibration absorbing mechanism is disclosed in the prior art that mechanically isolates vibration created by the vibrating motor of a hand held massager from a user's hand holding the vibrating device.

It is relatively complicated, and therefore relatively costly, to engineer a hand held motorized massaging or applicator device that relies upon a strong motor or a mechanical gear assembly to overcome resistance to pressure applied to the applicator surface. The costs are increased by both the number of parts and the mechanical tolerances of parts manufactured and assembled to create a functional massager. There is therefore a need for a less expensive device.

In addition to this need, no hand held motorized massager, liquid applicator or toothbrush exists that also dispenses contained fluid onto skin or hair under water, while its user is bathing or showering. Further, no such device is known that minimizes vibrational energy to the user's hand holding the device during use. Still further, no such hand-held household device that is cost effective to produce has been disclosed, nor has any method for its use or manufacture been revealed to date by any party.

DRAWING DESCRIPTION

Several embodiments, including the preferred embodiment, are disclosed in the accompanying drawing which includes the following figure (Figs.), with like numerals indicating like parts:

While these Figures may illustrate elements or components of embodiments of the disclosed device, it will be appreciated that the present disclosure may extend to equivalents thereto without departing from the scope of the disclosure.

DETAILED DESCRIPTION

Figure 1:
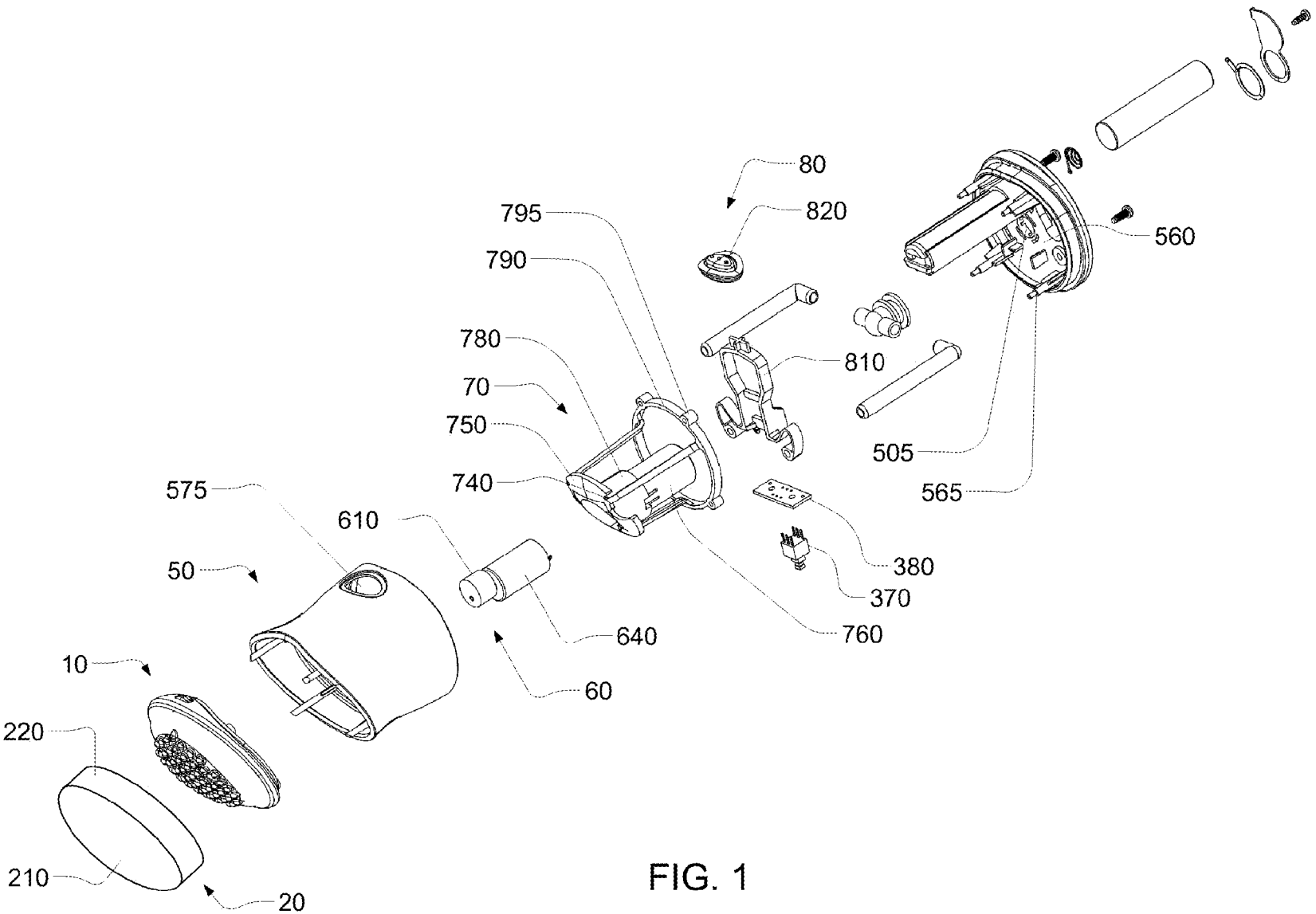
FIG. 1 is an exploded top and side perspective view of one embodiment of the a portion of the device of this disclosure.
Figure 4:
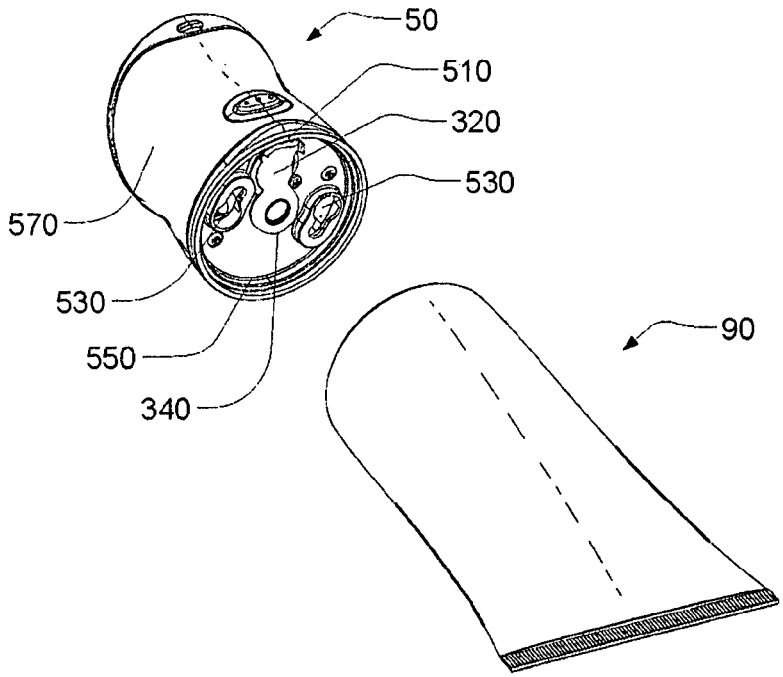
FIG. 4 is a partial exploded perspective view of one embodiment of the disclosed device as viewed from the bottom and side.
Figure 5:
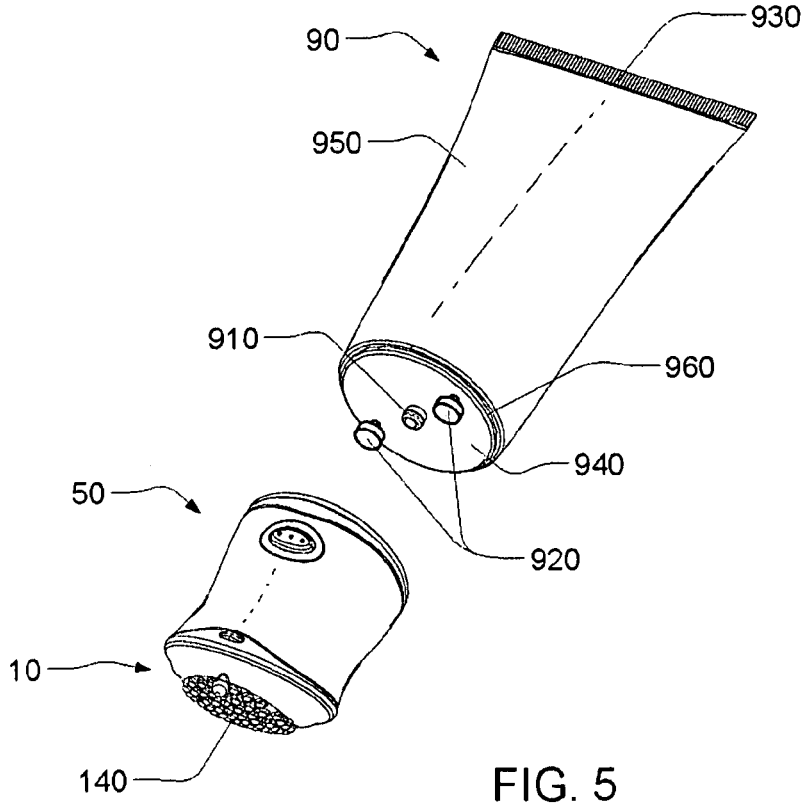
FIG. 5 is a partial exploded perspective view of one embodiment of the disclosed device as viewed from the top and side.

Referring to one embodiment of the disclosure, which is a preferred embodiment and is illustrated in the FIGS. 1, 4 and 5, this embodiment comprises a cap 20, an applicator 10, a housing 50, a fluid container 90, and additional components enclosed by the housing 50 which serve to power the motor 60 and to deliver fluid from the container 90 to the exterior surface of the applicator 140.

The cap 20 preferably comprises a translucent plastic and defines a wall 220 and a top 210. The wall 220 is configured to snap fit or otherwise enclose the applicator 10.

Figure 6A:
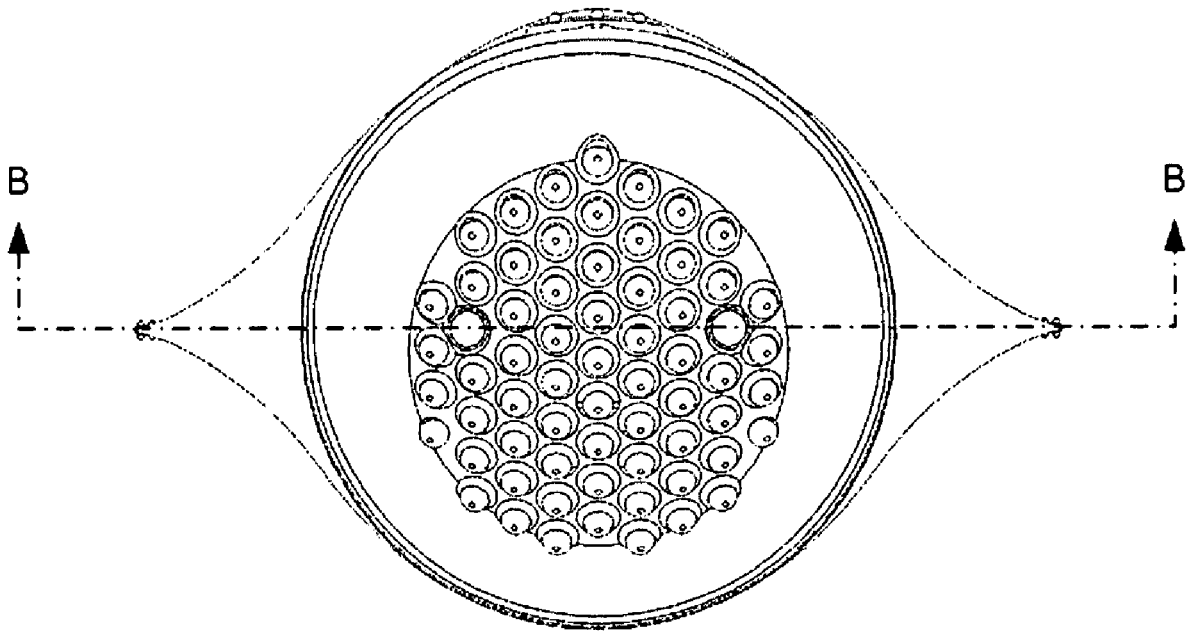
FIG. 6A is a top view of the disclosed device illustrating a sectional plane B defined along the xz plane.
Figure 6B:
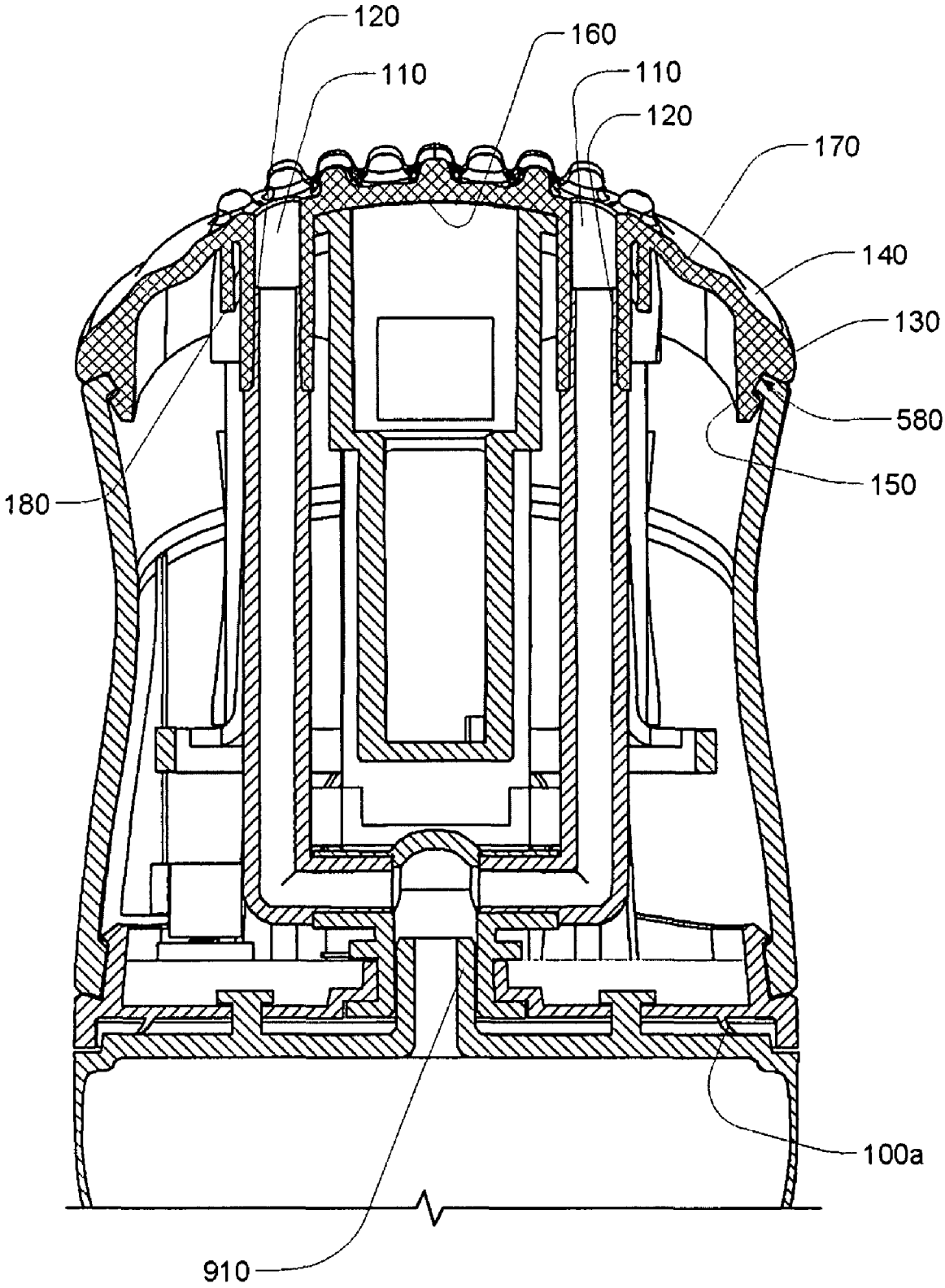
FIG. 6B is a section view of one embodiment of the disclosed device taken along plane B defined in the xz plane.
Figure 6C:
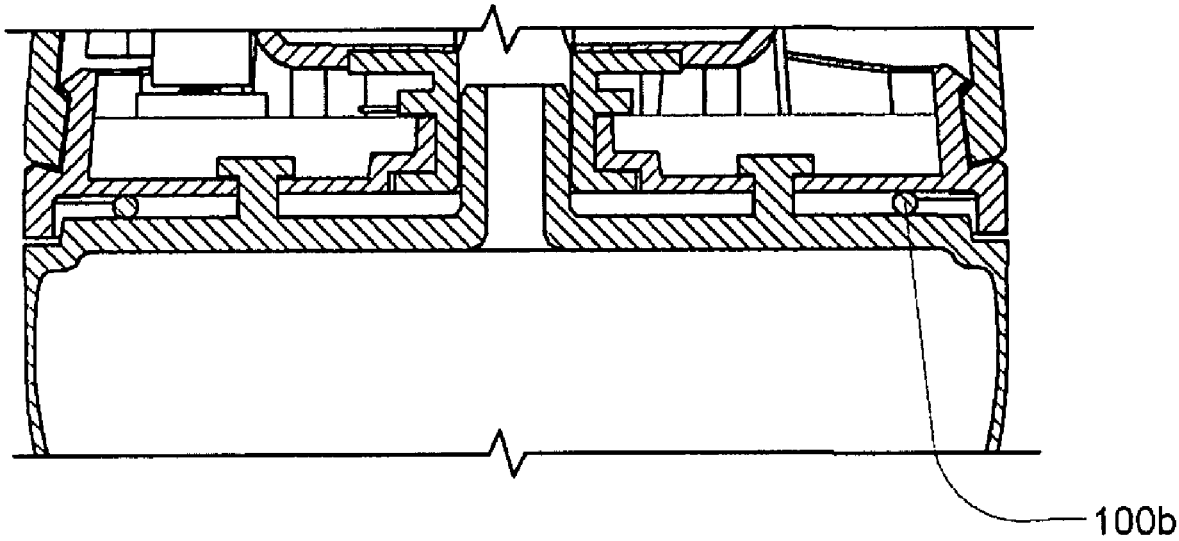
FIG. 6C is a section view of another embodiment of the disclosed device along plane B and the xz plane.
Figure 7A:
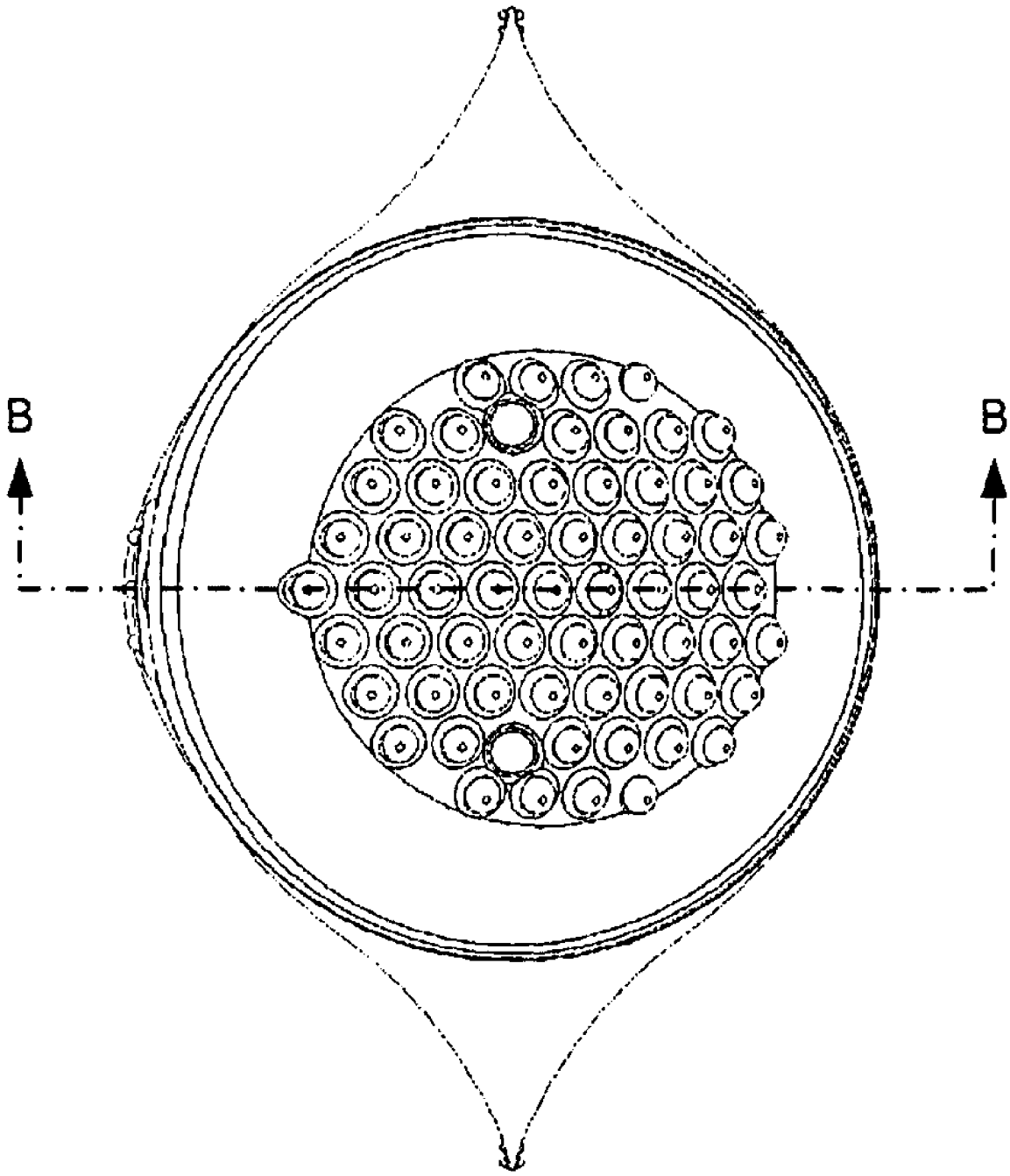
FIG. 7A is a top view of one embodiment of the disclosed device illustrating a sectional plane B along the yz-axis.
Figure 7B:
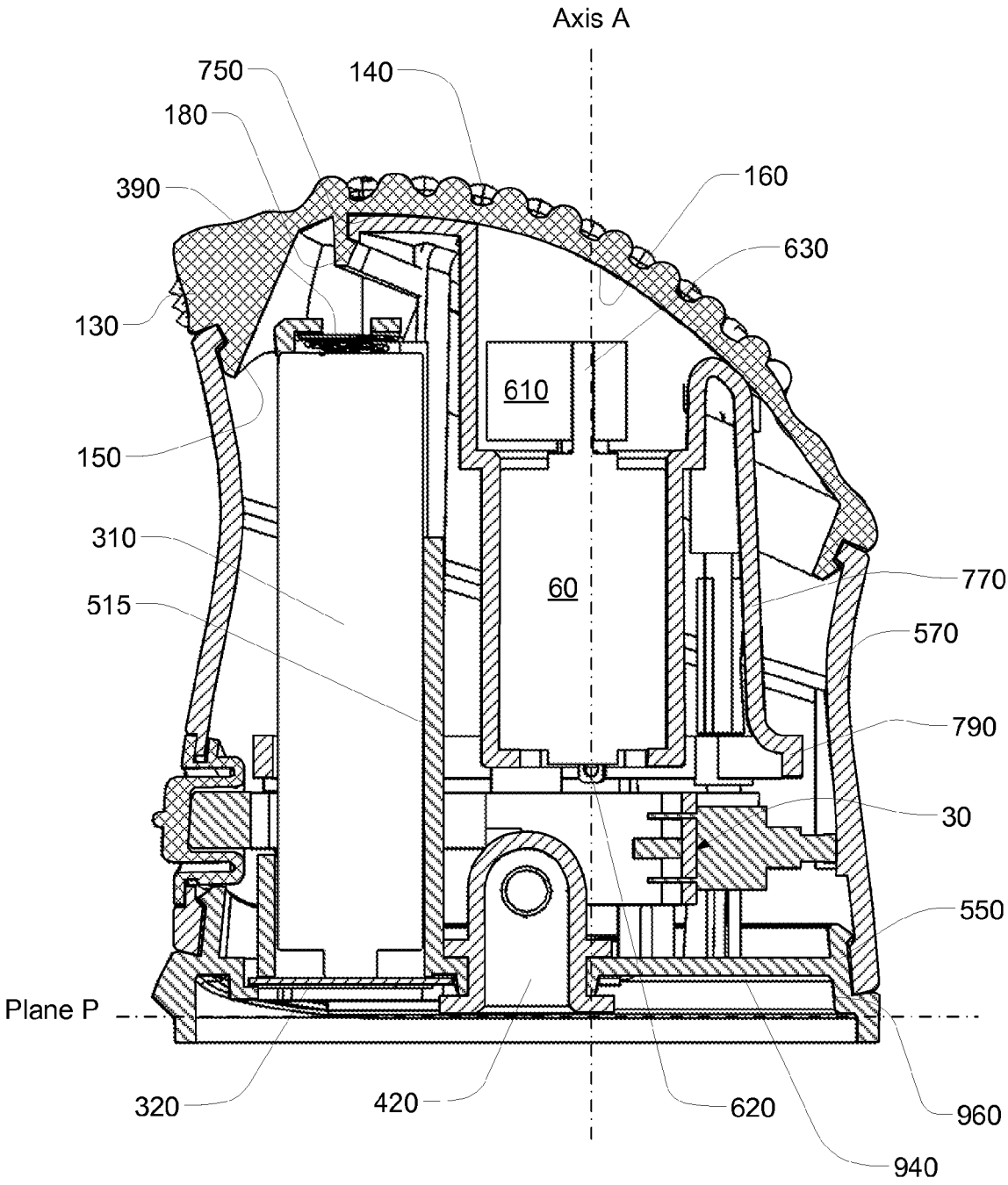
FIG. 7B is a sectional view of one embodiment of the disclosed device along plane B defined in the yz plane.

Continuing to provide details of an embodiment, FIGS. 5, 6B and 7B illustrate that the device of the disclosure comprises an applicator 10 with an exterior applicator surface 140, which surface defines an exterior 130 and an interior rim 150. The surfaces 130, 140 also defines at least one channel opening 110, which opening 110 is adapted to permit fluid flow therethrough. In one embodiment, at least two openings 110 are so defined.

Figure 2:
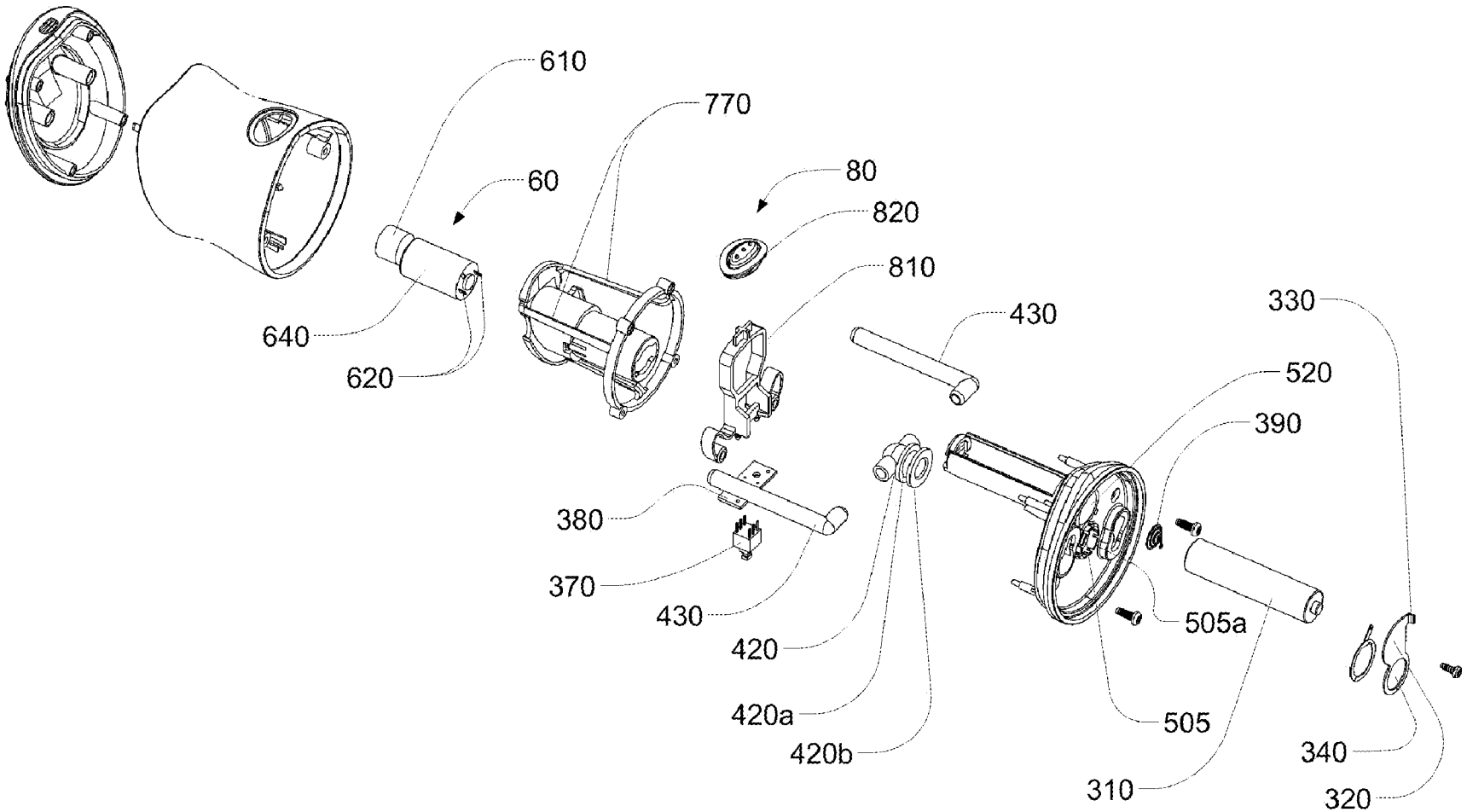
FIG. 2 is an exploded bottom and side perspective view of one embodiment of the disclosed device.
Figure 8:
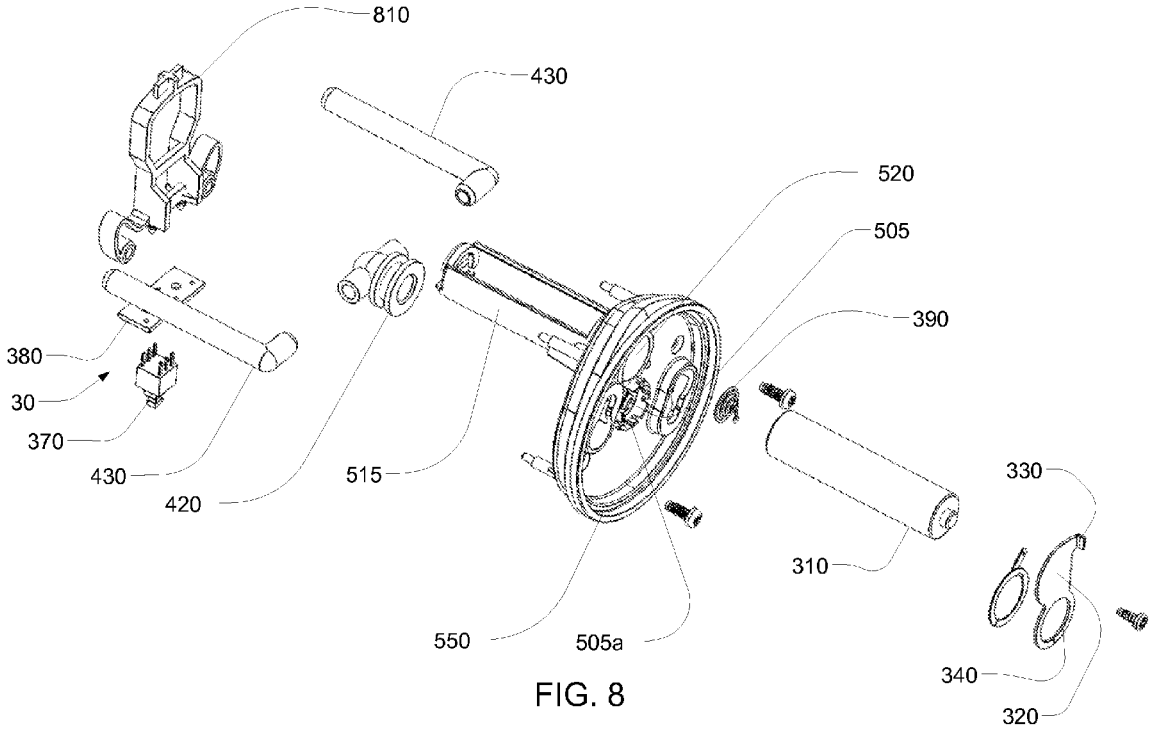
FIG. 8 is an enlarged side and bottom partly exploded view of one embodiment of the disclosed device.

The side opposite the exterior applicator surface 140 defines at least an interior surface 160, and as many channel sleeves 120 as there are channel openings 110. Each sleeve 120 defines a hollow core aligned with the mouth of a corresponding channel opening 110. While the applicator end of each of said channel sleeve 120 aligns with and co-defines its corresponding channel opening 110, the other end of each said sleeve 120 defines a hollow tube adapted to sealingly and snugly mate with the upright end of a pipe-L fluid conduit 430, as illustrated at FIGS. 2, 7B and 8. Such seal effectively allows fluid within these sealingly connected conduits to pass therethrough, but prevent any fluid from leaking out of joints between components, for example the sleeve 120 and the conduit 430.

The interior surface 160 of the applicator 10 further comprises a suspension seal 180 configured to both mechanically and frictionally mate with a motion concentrator 70, as illustrated at FIGS. 6B and 7B.

The applicator 10 comprises of a pliable, waterproof, washable material. The applicator 10 may preferably comprise silicone rubber, polyurethane, or any material having a Shore® A durometer hardness of about 30 to about 60.

The exterior 130 and interior rims 150 of the applicator 10 define a groove 170 therebetween. When the device of the embodiment is constructed, an upper aperture of a housing 580 of the device will be permanently attached to the applicator 10 by bonding the aperture 580 within the groove 170 defined by the inner 150 and outer 130 applicator rims. While the use of a groove 170 with the shape as disclosed by FIGS. 6B and 7B is a preferred embodiment, it is not the only shape of groove 170 that may effect a waterproof seal.

The components or elements of the device disclosed herein, such as for example the applicator 10 and housing 50, may be permanently affixed to one another by any one of several methods known in the art that creates a watertight or waterproof bond therebetween. In one embodiment, an applicator ring (not shown) comprising a stiff commercial grade plastic, polypropylene, polyolefin, or acrylonitrile butadiene styrene comprises an applicator end and a housing end. The applicator end may be permanently affixed within the groove 170. The housing end is configured to create a waterproof seal when it is snap fit with the housing upper aperture 580. Such waterproof snap fit may comprise any configuration known in the art of components, including but not limited to a chamfered leading edge of the housing end of the applicator ring or of the housing upper aperture 580; a pair or more of anchor tabs that fit into a groove; and a shouldered groove configured to accept and mate with a shouldered tab. In an embodiment comprising an applicator ring, the applicator 10 is permanently affixed to the applicator ring itself.

Such adhesion methods between components or materials of the disclosed device may include, but are not limited to, adhesive bonding, thermal bonding, ultra sonic bonding, and the like. However, the preferred embodiments afford inexpensive assembly and durability.

The exterior surface 140 of the applicator 10 may define several shapes suitable for applying fluid to human skin or hair. In one embodiment, the exterior surface 140 defines a number of small nubs or bumps, which when the motor 60 of the device is activated, transmit a massaging motion to the human skin or hair contacting the exterior of the applicator surface 140. Other exterior surface 140 variations comprise but are not limited to a ribbed surface, a smooth surface, or an indented surface. Any surface that provides a pleasant sensation when the exterior applicator surface 140 is placed in contact with human skin or hair may be used.

Figure 9A:
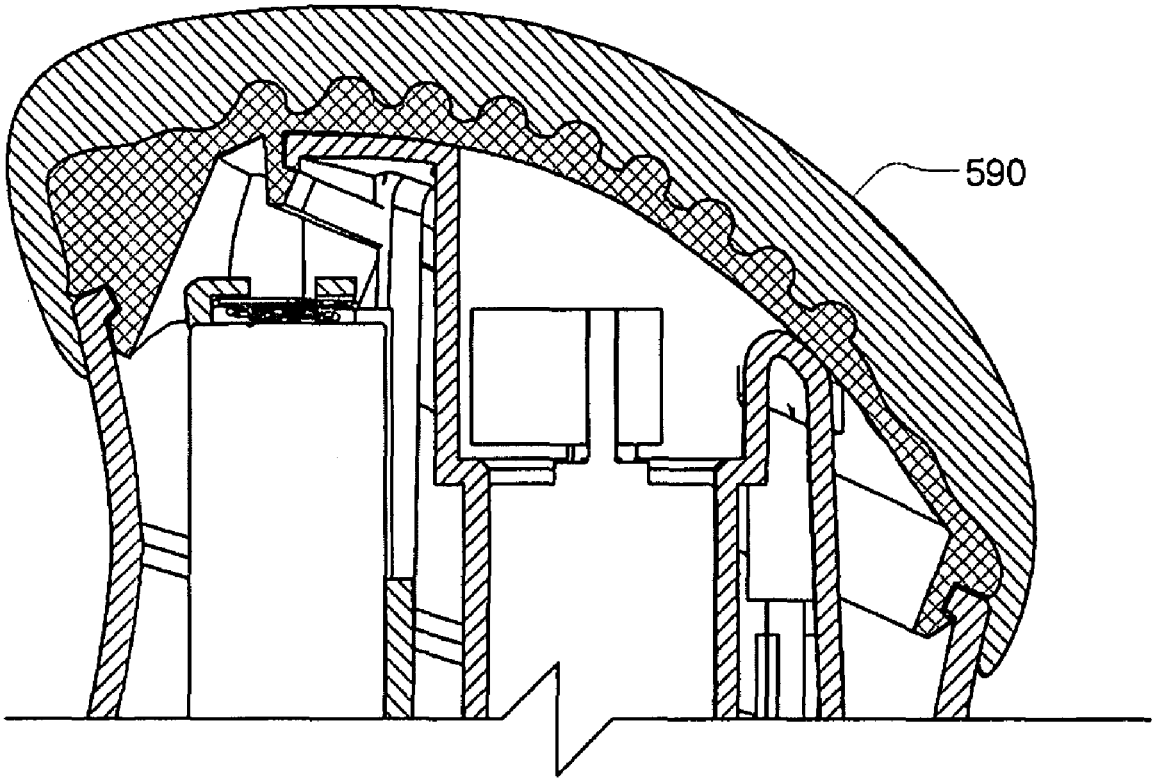
FIG. 9A is a sectional view of one embodiment of the disclosed device along plane B defined in the yz plane.
Figure 9B:
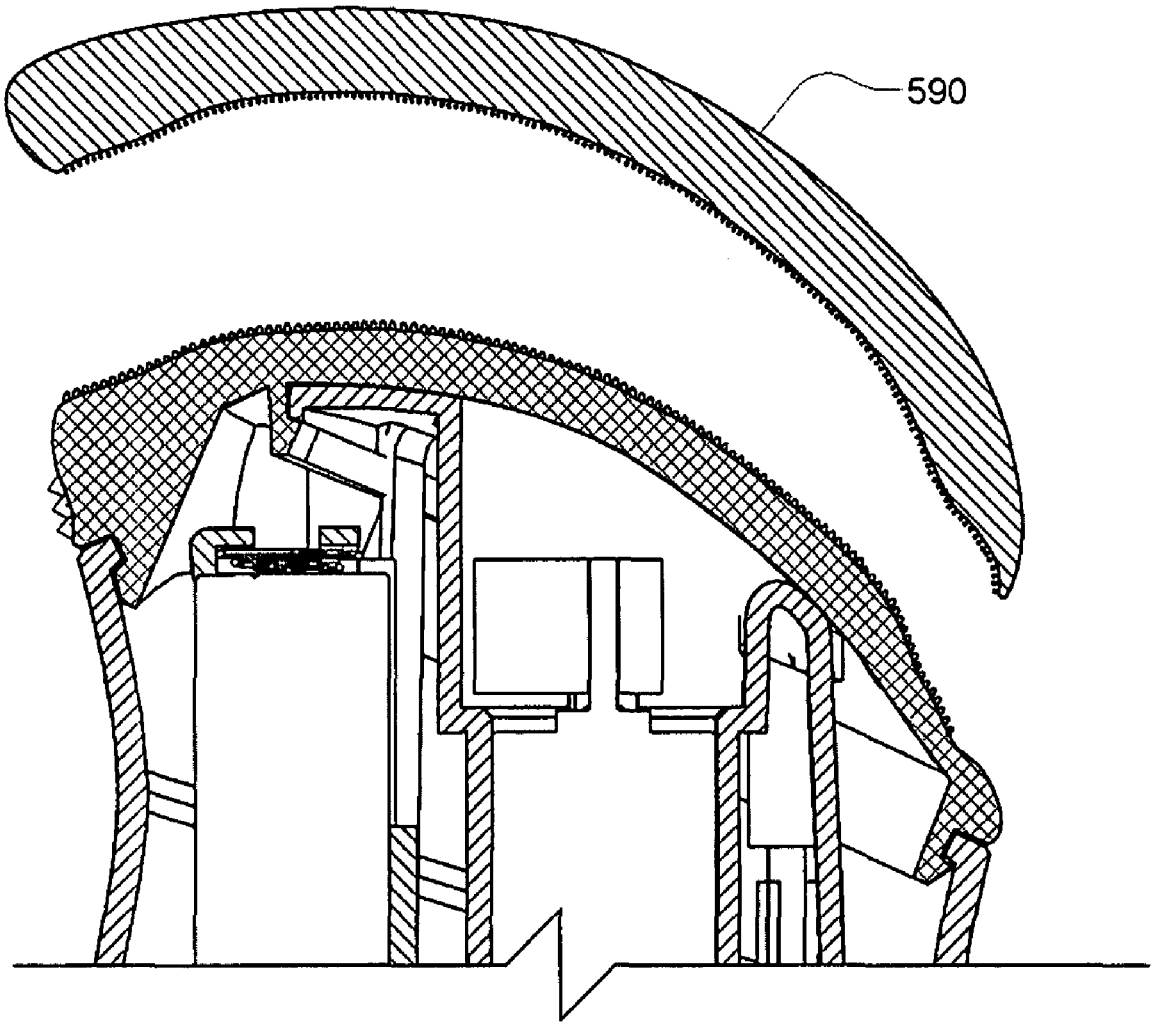
FIG. 9B is a sectional view of another embodiment of the disclosed device along plane B defined in the yz plane.
Figure 9C:
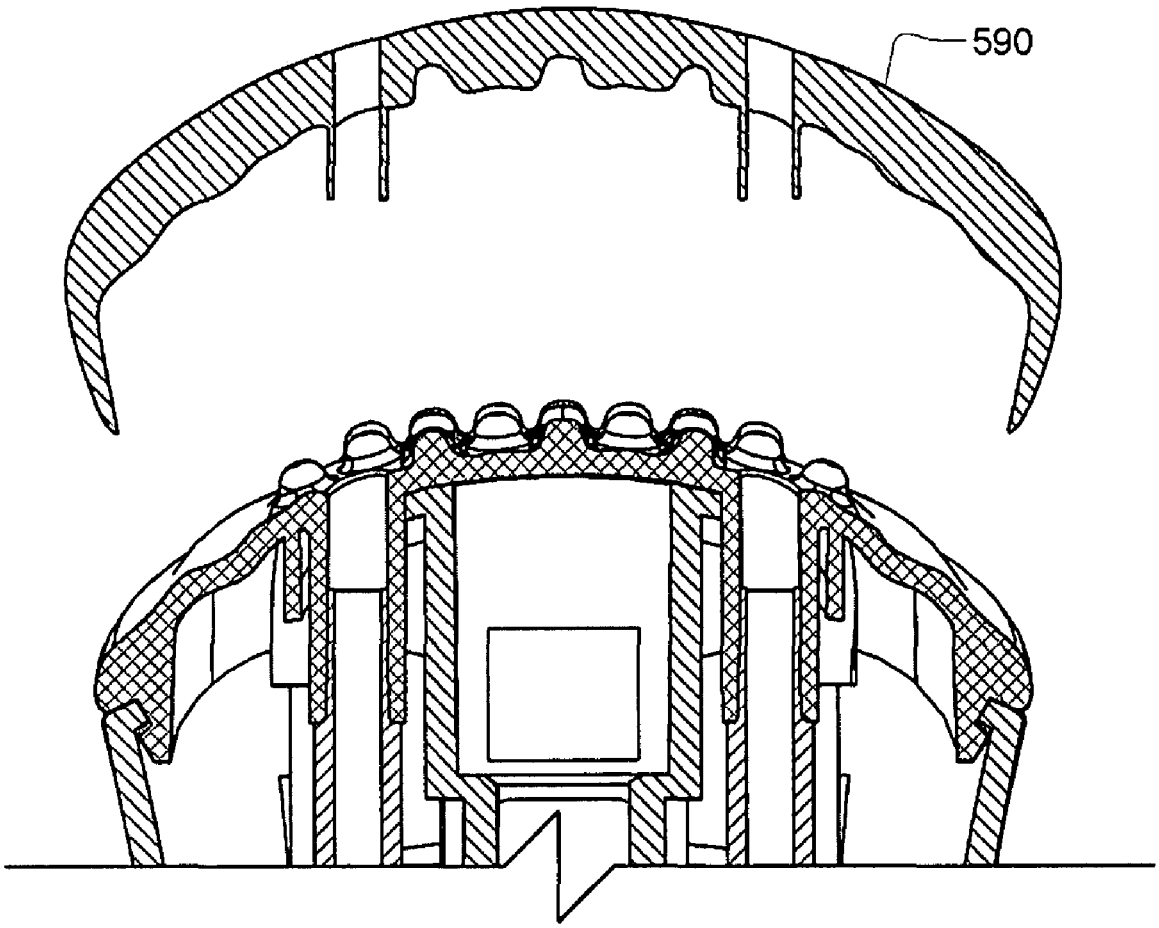
FIG. 9C is a sectional view of yet another embodiment of the disclosed device along plane B defined in the yz plane.

Additionally, as illustrated in FIGS. 9A, 9B and 9C, the exterior surface of the applicator 140 may comprise a bonding surface adapted to removeably affix a pad 590 to the exterior surface of the applicator 140. Such bonding layer may comprise an adhesive material, one surface of a loop and/or hook material, or the like. In the case of using a loop and hook adhesion system, there is no preference given to whether the loop or the hook surface is attached to the applicator exterior surface 140 or to the underside of applicator pad or sleeve 590 that will mate with the applicator's exterior surface 140. This pad 590 may comprise a differently configured applicator surface.

The pad 590 may also comprise a sachet containing heat or cold producing compounds. One such product is an air activated, heat releasing mixture, sold under the trademark HEAT TREAT® (U.S. Pat. No. 2,854,530). This product comprises a water permeable membrane that encloses a mixture of carbon, cellulous, vermiculite, sodium acetate, activated carbon, and iron. The composition contained within the water permeable membrane of this product is heated when the product comes in contact with air. After use, the removable pad 590 is discarded. A multi-use heating or cooling pad is also within the scope of this disclosure.

The exterior surface 140 of the applicator 10 may also be adapted to mate with an inner surface of a removeably attachable, microwavable or coolable gel pack. This gel pack is commonly available and typically comprises a semi-solid gel enclosed in a synthetic, water impermeable membrane.

The exterior surface 140 of the applicator 10 also may be adapted to removeably adhere to the underside of a sleeve 590, which sleeve is adapted to fit over the applicator 10 entirely and encompass it. In another embodiment, the sleeve 590 is configured to stretch fit or snap fit over the applicator 10, and requires no adhesive.

In yet another embodiment, any pad 590 removeably affixable to the applicator 10 further comprises one or more hollow sleeves (not shown) depending from the apertures in the pad 590. Such sleeves require the pad 590 to be properly aligned on the applicator 10 to permit fluid to be transmitted therethrough.

In yet a further embodiment, the motor will not turn on unless the one or more hollow sleeves depending from the pad 590 are correctly aligned and positioned within the one or more applicator apertures.

Regardless of its configuration or contents, the preferred embodiment of the pad or sleeve 590 also permits fluid application therethrough. One embodiment provides apertures in the pad 590 that line up with the applicator openings 110 when the pad is correctly positioned on the applicator 10. Unless the pad 590 is correctly positioned, fluid will not flow out of the applicator openings 110.

Turning now to other components of the disclosed device and FIGS. 2 and 8, a housing 50, described in more detail below, supports the applicator 10, and is sealingly attached thereto. The housing 50 comprises a material with a Shore® A durometer hardness from about 30 to about 60. Preferably, the housing 50 comprises any class of rigid polypropylene or polyolefin. It may also comprise acrylonitrile butadiene styrene. The housing 50 comprises at least one wall 520 of a preferable height of from about 1 inch to 2 inches. It will be appreciated that these examples of preferred embodiments do not limit the scope of this disclosure so as to exclude equivalents.

The at least one wall of the housing 570 defines a housing upper aperture 580 at one end of the at least one wall 520, which housing 50 also comprises a housing floor 510 proximate the at least one wall's 570 other end. The housing upper aperture 580 sealingly mates with the groove 170 defined by the inner 150 and exterior rims 130 of the applicator 10.

In a preferred embodiment, the wall 570 defines a generally cylindrical shape, and the housing upper aperture 580 itself, or the applicator ring (not shown), is permanently mated and sealed in its position between the inner 150 and outer applicator rims 130. In a preferred embodiment, the applicator 10 is sealed to the housing 50 or is sealed to the applicator ring (not shown) by adhesion, which adhesion may be affected by any method commonly known in the art.

The housing 50 also comprises a motor 60 and an electrical circuit to power the motor 60 in FIGS. 1,2,3 and 7B. The motor 60 comprises a motor body 640, a motor axle 630, electrical leads 620, and a weight 610 eccentrically mounted on the motor's axle 630. When direct, low voltage current is supplied to the motor 60 by a battery 310 connected to the motor's leads 620, the motor 60 is turned ON and spins its axle 630. The revolution of the eccentrically mounted weight 610 about the motor axle 630 imparts vibrational energy to the motor 60 and to all components directly and frictionally connected thereto.

It is not typically pleasant for a user to hold a vibrating device for extended periods of time. To minimize vibration to a user's hand while the user is practicing the method of, or is manipulating the device, of the disclosure, the motor 60 is mounted within the housing 50 on a motion concentrator 70. The motion concentrator 70 comprises a motor cradle 760, a weight chamber 780, a motion contact surface 750, an annular support ring 790, and at least one support leg 770. In a preferred embodiment, there are three support legs 770, and the ratio of the length of each of the support legs to its thickness is preferably about 10:1.

The motor cradle 760 snugly and firmly holds the motor 60. The weight chamber 780 extends from the cradle 760, and is configured to permit the eccentric rotation of the weight 610 about the motor axle 630 without the weight 610 contacting the sides of the weight chamber 780.

The weight chamber 780 is itself connected to at least one motion contact surface 750. At least one motor concentrator leg 770 depends from this surface 750. The motion contact surface 750 is fixedly connected to the motor cradle 760 and weight chamber 780, and therefore is vibrated or oscillated by the rotation of the eccentrically mounted weight 610 when the motor 60 is ON. The one or more legs 770 are adapted to suspend the motor cradle 760, and weight chamber 780 and contact surface 750 within the housing 50 while simultaneously preventing these components from bumping against the housing wall 50.

The motion contact surface 750 is further adapted to mechanically or to frictionally mate with the interior surface of the applicator 160 and the suspension seal 180 of the applicator (FIG. 6B). Through this mechanical and frictional mating, the motion contact surface 750 imparts the massaging vibrations generated by the motor 60 directly to the interior surface of the applicator 160. The applicator's exterior surface 140, being the opposite side of the inner surface 160, is also vibrated.

Figure 3:
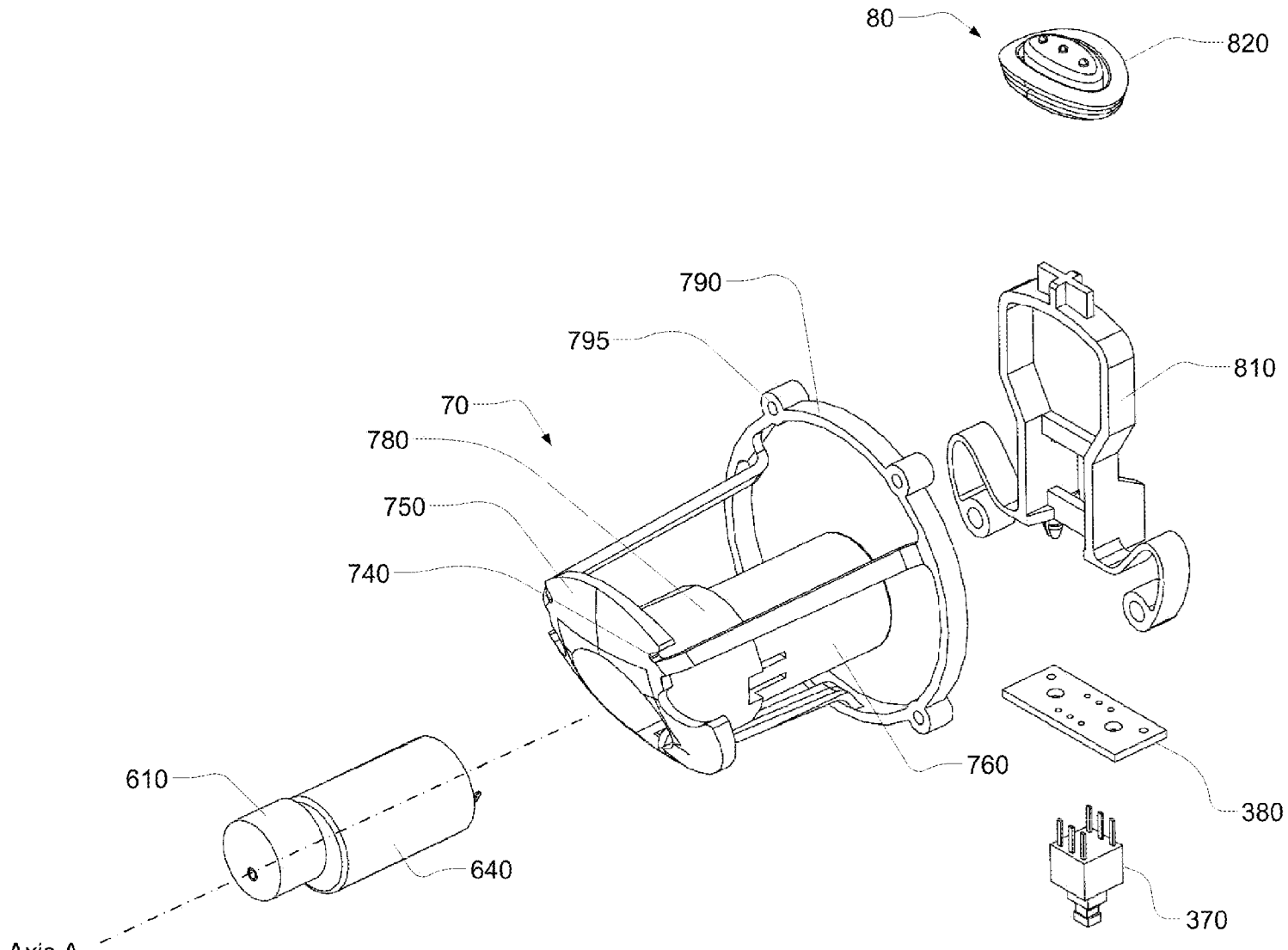
FIG. 3 is an enlarged exploded top and side perspective view one embodiment of the disclosed device.

With reference to FIGS. 1, 3 and 7B, at least one motor concentrator leg 770 depends from the motion contact surface 750, and at least one leg is/are footed in an annular ring 790. The at least one leg 770 is/are configured to permit eccentric movement of the motor 60 while absorbing or minimally transmitting eccentric movement between the contact surface 750 through the suspension legs 770 to the annular ring 790. The annular ring 790 is permanently affixed to the housing 50. In preferred embodiments, the annular ring 790 is affixed to the housing floor 510 or to the interior surface of the housing wall 570. Further, to isolate motion between the motor 60 and the housing 50, the contact surface 750 may define one or more grooves 740 flanking the area at which the top of each leg 770 becomes part of or joins the contact surface 750.

The motor cradle 760 is also configured to permit electrical leads 620 located at one end of the motor 60 to connect with the battery 310 and a microswitch 370. This microswitch 370 controls the ON/OFF state of the motor 60.

In a preferred embodiment, FIG. 6B, the applicator 10 comprises a flexible material that is thicker at its rims 130, 150 than it is at an annular area 170 directly adjacent and towards the center of the applicator 10. Because of this thinner area 170, vibration of the applicator's inner and outer surfaces 140, 160 is absorbed and not fixedly translated to its rims 130, 150 or the attached housing 50. The thin layer 170 therefore decreases vibration to a user's hand holding the device of the disclosure.

During its intended use, a user presses the applicator surface 140 against skin or hair. This pressure is absorbed by deforming the motor concentrator legs 770, FIGS. 2 and 7B. These legs 770 preferably comprise polypropylene or polyolefin, and the geometry of each leg 770 comprises a length about ten times its thickness. The contact surface 750, weight chamber 780 and motor cradle 760 are not deformed, but are simply moved downwardly along the Axis A (FIG. 7B) as each leg 770 is deformed. Further, the components 750, 780, 760 preferably comprise a stiff polyethylene or polyolefin and may comprise a single molded piece. Regardless of manufacturing techniques used, the components 750, 780, 760 together comprise a protective chamber suspended by the legs 770 within the housing 50.

Were pressure exerted through the applicator 10 to bear directly on the rotating weight 610, it would be applied along its Axis A (FIG. 7B) of rotation and so minimally affect its rotation. In a preferred embodiment, the axle 630 therefore lies along Axis A, or along an axis normal to Plane P. The Axis A may be said to be equivalent to the z axis, and the Plane P may be said to lie upon the plane defined by the xy axes of a common three dimensional Cartesion xyz coordinate system, commonly known in the art.

Suspending the motor 60 within the housing provides unrelated benefits, namely to protect the massaging action of device from pressure, and to decrease unpleasant vibration felt in the hand holding the device during use. In a preferred embodiment, the applicator surface lies at an angle of 45 degrees or less when measured from Plane P (the xy plane).

As in FIGS. 2, 4, 7B and 8, an electrical circuit, interrupted by manually controlled ON/OFF switch 80, electrically connects the poles of the battery 310 to the electrical leads of the motor 620. A flexible electrical switch cover 820 seals the housing aperture 575 while allowing operation of the ON/OFF switch 80. Several electrical low voltage circuits known in the art could be used.

In the preferred embodiment of the disclosure, such an electrical circuit comprises: an electrically conductive battery door cover 320 contacting the positive battery pole of the battery 310; an electrically conductive washer 330 encircling a central floor aperture of the housing 505 and in electrical contact with the battery door cover 320; an electrical connector (not shown) between the washer 330 and a first electrical pole of a printed circuit board 380; one pole of a microswitch 370 electrically attached to the first circuit board pole 380; a second pole of a microswitch 370 electrically attached to the second printed circuit board 380 pole; and an electrical conductor (not shown) connecting the second microswitch pole 370 to an electrically conductive spring 390 positioned at, and in electrical connection with, the negative battery 310 pole.

Continuing to reference FIGS. 2, 4 and 8, a battery opening 520 is defined by the floor of the housing 510, and is configured to permit sliding a battery 310 therethrough (FIGS. 2 and 8). This battery opening 520 is adjacent the housing central aperture 505. The electrically conductive battery door cover 320 is adapted to cover the battery opening 520 and to encircle the housing central aperture 505. The cover 320 pivots about the aperture 505 because the cover 320 comprises a pivot ring 325 adapted to pivotally encircle the aperture 505. This cover 320 creates part of the electrical circuit described above when the cover 320 is positioned to close over the battery opening 520.

Additionally, a contact washer 330 encircling the same housing central aperture 505 lies between the cover's pivot ring 340 and the housing aperture 505. A battery door handle 330 may extend at an angle away from the battery door cover 320 to permit user rotation of the battery door cover 320 over and away from the battery opening 520. The lower surface of the housing floor 510 also defines a battery door seating 510, which seating 510 both stops rotation of the battery door cover 520, and creates a waterproof seal.

In another embodiment of disclosure, a switch 80 directly manipulated by a user may be replaced or supplemented. The microswitch 370 is positioned adjacent one of the supporting legs 770. When a user applies pressure along the z-axis on the applicator 10, the supporting leg 770 is deformed and contacts the microswitch 370, thereby controlling the motor 60. The motor 60 of the device is therefore controlled in various embodiments by a directly manipulated switch 370 by a leg 770, or both.

As stated above, the battery door cover 320 and pivot ring 340 are positioned about central aperture in the housing floor 505. This aperture 505 is sized to permit fluid from the container 90 to flow through the aperture 505. The aperture is preferably lined by the stem of a connector-T 420 which is itself adapted to permit fluid to travel therethrough. In the preferred embodiment, the connector-T 420 comprises a flexible material, for example, silicone, which will affect a watertight seal between the aperture in the housing floor 505 and the container nipple 910 when the components of the device of the discloser are assembled.

The connector-T 420 comprises a stem and a pair of arms, and is hollow throughout, to permit fluid flow therethrough. In a preferred embodiment, parallel annular rings 420*a*, 420*b*, are located apart on the stem of the connector-T 420 (FIG. 2). This pair of rings 420*a*, 420*b* sandwiches a central housing aperture 505 defined by the housing floor. The aperture 505 may additionally define prongs or extensions 505*a* spaced apart from the housing floor 510. The prongs 505*a* are snugly positioned between the connector-T flanges 420*a*, 420*b* and allow little movement of the T-connector 420.

Each of the connector-T 420 two branches is connected to a pipe-L 430. The lower branch of each pipe-L 430 extends outwardly from the connector-T 420, and is each pipe-L 430 is fluidly connected to the connector-T 420 by a watertight seal. The top leg of each pipe-L 430 is inserted into the applicator channel sleeves 120 and each pipe-L 430 forms a waterproof fit with each channel sleeve 120.

The lower surface of the housing also defines a floor sealing rim 550 (FIGS. 4, 7B and 8). Adjacent the floor sealing rim 550 is a sealing component 100, for example, a sealing flared torus 100*a*, or an O-ring 100*b*. These sealing components preferably comprise silicone rubber or polyurethane having a Shore® A durometer rating of about 30 to about 60. In a preferred embodiment, this sealing component comprises a flexible flared torus 100*a* co-molded to the housing floor 510. The geometry of this flared torus 100*a* comprises about a 5 degree conical angle, with the broader end of the cone attached to the floor sealing rim 550. The conical torus 100*a* is positioned to splay outwardly to create a waterproof seal between the floor sealing rim 550 and a housing end 940 of the container 90 when the housing 50 and container 90 are attached. The housing end of the container 940 further defines a rim 960 adapted to mate with the rim of the housing floor 550. As described in some detail above, a co-molded conical torus 110*a* may provide waterproof sealing between the housing end of the tube 940 and the rim of the housing floor 550. In an alternative embodiment, an O-ring 110*b* may be used n addition to or in lieu of the co-molded conical torus 100*a* to ensure a water tight seal between the container 90 and the housing 50.

Referencing FIGS. 5 and 7B, the housing end 940 of the container 90 that becomes removeably attached to the housing 50 is shaped to abut and fit within the floor sealing rim 550. The housing floor 510 defines at least a pair of keyhole apertures 530 adapted to accept and lock with a pair of bayonet studs 920 extending upwardly from the container's closed end 930.

When the bayonet studs 920 are mated and locked into the keyhole apertures 530, the housing 50 and container 90 are removably attached. As the housing end 940 is urged to abut and fit within the floor sealing rim 550, the conical torus 100*a* is deformed outwardly and comprise a waterproof seal.

At least one housing wall 520 ascends upwardly from the housing floor 510, defining a battery holding silo 515 (FIGS. 7B and 8). The silo 515 is configured to snugly enclose a battery 310. At an end of the silo 515 opposite the battery opening 520 is positioned a spring contact 390 which comprises part of the electrical circuit 30.

To more fully explain the device of the disclosure, the fluid transfer system is now described. As detailed above at least a pair of bayonet keyholes 530 are adapted to mate with at least a pair of bayonet studs 920 extending from the container 90. The housing end of the container 940 additionally defines an aperture 910 which may be in the shape of a nipple and that is adapted to permit fluid passage therethrough.

The container 90 preferably comprises a flexible tube, or a flexible bottle or tottle. Fluid is expressed out of the container 90 through its aperture 910 when a user squeezes or otherwise deforms the flexible container to reduce its effective volume. Fluid may also be expressed when the container 90 is repositioned to permit gravity to effect expression of fluid therefrom. The container 90 also defines at least one side 950 and a closed end 930.

Fluid for skin, hair or body care is enclosed within the container 90, and may exit only through the single aperture 910. The aperture 910 is adapted to snugly and sealingly mate with the connector-T 420. Fluid from the container 90 may then flow unimpeded from within the container 90, out its aperture 910, through the connector-T 420, through the pipe-L 430 conduits and applicator sleeves 120, and out to the surface of the applicator 10 by means of the aperture channels 110.

Additionally, the lower end of the connector-T 420 may be configured to frictionally fit within the central housing aperture 505 and to be compressed. When the container 90 is rotated relative to the housing 50 and mated therewith.

In a preferred embodiment, (FIGS. 2 and 8) the lower end of the connector-T 420 further comprises at least a pair of spaced apart annular rings 420*a*, 420*b* that extend outwardly from the outer wall of the connector-T 420 stem. Further, the central aperture 505 comprises one or more projections 505*a* positioned adjacent the central aperture 505. In a preferred embodiment, the projections 505*a* depend from the lower housing wall 540. The projections 505*a* are adapted to fit between the annular rings of the connector-T 420*a*, 420*b* and to create a watertight seal between the aperture 505 and the ring 505*a*.

An annular ring of the motion concentrator 790 may be connected to the interior floor of the housing 560. In the preferred embodiment, sockets 795 defined by the annular ring 790 are permanently mated with projections 565 from the housing 50 extending through said sockets 795. Screws may be used to more firmly affix together these sockets 795 and projections 565.

To further accommodate the position of the motor, a switch bracket 810 may be positioned around, but apart from, the motion concentrator 70 within the housing 50. Thus configured, the bracket 810 mechanically transmits mechanical depression of the switch 80 to the microswitch 370, but isolates the electrically conductive microswitch 370 from the switch aperture 575 defined by the housing 50, through which fluid might come into contact with the microswitch 370. Additionally, the bracket 810 acts as a spring when a user manually depresses the switch 80, pushing the switch 80 outwards, through the switch aperture 575. The bracket is further configured to avoid contacting the pipe-L channels 430.

While examples of element or component materials, or examples of elements of components, may be provided herein, it will be appreciated that the present disclosure may extend to equivalents thereto without departing from the scope of the disclosure.

What is claimed is:

1. A motorized waterproof fluid dispenser for use in a bath or shower comprising:

a. a waterproof container comprising at least one fluid compartment and at least one fluid dispensing aperture;

b. a waterproof applicator defining at least one fluid opening;

c. a waterproof housing positioned between and sealingly connecting the container and the applicator, and defining a watertight cavity therebetween;

d. at least one length of fluid conductive tubing positioned within the housing cavity, the conductive tubing connecting at least one dispensing aperture to at least one fluid opening;

e. a low voltage, direct current battery powered motor positioned within the housing cavity, the motor comprising an axle rotatable about an axis, and a weight eccentrically mounted on the axle, the motor further comprising at least one motor controlling switch;

f. a movement concentrator comprising at least one surface positioned within the housing cavity between the motor and the applicator, the movement concentrator additionally comprising at least one movement absorbing leg; and g. at least one watertight housing seal positioned between the housing and the container.

2. The dispenser according to claim 1 wherein the applicator comprises an elastic material.

3. The dispenser according to claim 1 wherein the applicator comprises a material having a durometer hardness of about 30 to about 60.

4. The dispenser according to claim 1 wherein the applicator comprises silicone.

5. The dispenser according to claim 1 wherein the waterproof fluid filled container comprises a flexible tube, bottle or tottle.

6. The dispenser according to claim 1 wherein the housing comprises at least one material selected from a group comprising rigid polyethylene, polypropylene, polyolefin, acrylonitrile butadiene styrene or commodity grade plastic.

7. The dispenser according to claim 1 wherein the applicator is permanently affixed to a stiff applicator ring, and the applicator ring is permanently snap fitted to the housing.

8. The dispenser according to claim 1 wherein the motor axis is aligned with a z axis and the eccentrically mounted weight rotates in an xy plane substantially normal to the z axis.

9. The dispenser according to claim 1 wherein the motor switch comprises a manually operated switch.

10. The dispenser according to claim 1 wherein the motor switch comprises a pressure activated switch positioned to control the motor when pressure is applied along an axis substantially parallel to the motor axis.

11. The dispenser according to claim 1 wherein the movement concentrator surface mechanically transmits movement generated by the eccentrically rotating weight to the applicator.

12. The dispenser according to claim 1 wherein the movement concentrator comprises stiff acrylonitrile butadiene styrene or commodity grade plastic.

13. The dispenser according to claim 1 wherein the movement concentrator comprises at least one leg having a length of about 10 times its thickness.

14. The dispenser according to claim 1 wherein the at least one movement concentrator leg absorbs vibrational energy generated by rotation of the eccentrically mounted weight.

15. The dispenser according to claim 1 wherein the at least one watertight housing seal positioned between the housing and the container comprises at least one flexible conical torus.

16. The dispenser according to claim 1 wherein the at least one watertight housing seal positioned between the housing and the container comprises at least one O-ring.

17. A motorized waterproof fluid dispenser for use in a bath or shower comprising:

a. an applicator comprising an exterior applicator surface, an interior applicator surface, and a thickness therebetween; at least one channel opening and at least one channel sleeve depending from the interior surface and aligned with said at least one channel opening; an exterior rim, an interior rim, a groove defined in the applicator by said interior and exterior rims; a suspension seal depending from the interior applicator surface; and an area of reduced thickness positioned between the suspension seal and the exterior rim;

b. a covering top adapted to removably cover the applicator;

c. an electrical circuit comprising a battery having a positive and a negative pole; an electrically conductive pivotable battery door cover positioned in electrical contact with the positive pole of the battery; a washer electrically connected to the door cover; a printed circuit board having two electrically connective poles, the first of which poles is electrically connected to the washer; a micro switch electrically connected to the printed circuit board and configured to alternately interrupt or to permit an electric current to flow through the circuit board by manually pressing the micro switch; an electrically conductive member connecting the second pole of the printed circuit board with a first electrical lead projecting from one end of the body of a direct current motor; an electrically conductive member connecting a second electrical lead of the direct current motor with the conductive spring, the spring positioned in electrical connection with the negative pole of the battery;

d. a fluid channel comprising a connector-T comprising at least a stem and a pair of branching arms; a pair of spaced apart annular rings extending away from the exterior surface of the connector-T stem; at least a pair of pipe-Ls, each pipe-L comprising at least a shorter end and a longer end, the shorter end of each pipe-L sealingly attached to one of the arms of the connector-T; the longer end of the pipe-L sealingly connected to the channel sleeves;

e. a housing comprising a stiff polypropylene having a durometer value of from about 30 to about 60; the housing further comprising at least one wall substantially aligned with a z-axis, the top of the at least one wall defining an aperture; the housing further comprising a floor adjacent an opposite end of the at least one wall, the floor lying substantially along an xy plane; the floor comprising at least an interior and an exterior surface and at least a central fluid input aperture; at least one projection depending from an exterior surface of the floor about the aperture; at least a pair of bayonet closure keyholes defined by the floor; a battery door and a battery door cover stop defined by the floor; a battery silo extending upwardly from the battery door the z axis, within which silo is positioned the electrically conductive spring; a floor sealing rim depending from the exterior surface of the floor and a co-molded conical torus positioned adjacent the sealing rim; and at least one switch aperture defined by the at least one housing wall;

f. the motor further comprising a direct current motor and an axle, the axle oriented parallel to the z axis and which spins about said z axis when the micro switch allows current flow; an eccentrically mounted weight positioned to generate eccentric in the xy plane when the micro switch allows current flow;

g. a motion concentrator comprising a motor cradle through which the motor's electrical leads extend, the cradle otherwise fixedly cupping the motor body; a weight chamber adjacent the eccentrically mounted weight, the chamber fixedly attached to the cradle and defining a both a greater circumference in the xy plane than the largest arc through which the eccentric rotation of the weight moves, and a greater height than that of the rotating weight; a motion concentrating surface extending first upwardly along the z axis and then axially outward therefrom substantially along the xy axis, the surface comprising an area that frictionally mates with the interior surface of the applicator and which is bounded by the suspension seal; at least one leg depending from the surface and connecting at its foot to an annular ring, the annular ring fixedly attached to an interior surface of the housing, each said leg comprising a length of about 10 times its thickness and comprising a stiff polyolefin; the length of each leg spaced apart from any other component of the device when the at least one leg is deformed;

h. a switch, the switch comprising a manually operable switch extending outwardly through a switch opening defined by the wall of the housing, a pliable watertight switch seal covering the switch and switch opening, and a switch bracket mechanically connecting the switch to the micro switch;

i. a container, the container comprising at least a closed end, a side, and a housing end; the housing end defining at least a pair of bayonet closure studs positioned to closingly extend through and mate with the housing bayonet keyholes; the housing end defining a rim sized to mate with the exterior floor of the housing when the bayonet closure studs are mated with the bayonet keyholes; the housing end still further defining at least one fluid aperture sized to fit within and sealingly mate within the stem of the connector-T; and j. at least one waterproof seal spaced centrally apart from the exterior rim, the seal sized to form a waterproof seal between the housing and the container when the housing and container are removably mated.

18. The dispenser according to claim 17 wherein the at least one waterproof seal comprises a flexible conical torus.

19. The dispenser according to claim 17 wherein the at least one waterproof seal comprises an O-ring.

* * * * *